US007013675B2

(12) United States Patent
Marquez-Pickering

(10) Patent No.: US 7,013,675 B2
(45) Date of Patent: Mar. 21, 2006

(54) SMOOTH BACKED PIERCED EARRING

(76) Inventor: Terri Marquez-Pickering, 10485 La Morada Dr., San Diego, CA (US) 92124

( * ) Notice: Subject to any disclaimer, the term of this patent is extended or adjusted under 35 U.S.C. 154(b) by 0 days.

(21) Appl. No.: 10/727,682

(22) Filed: Dec. 4, 2003

(65) Prior Publication Data

US 2005/0120743 A1 Jun. 9, 2005

(51) Int. Cl.
*A44C 7/00* (2006.01)

(52) U.S. Cl. ..... 63/12; 63/40; 63/13; 63/1.11; 63/1.16

(58) Field of Classification Search ..... 63/12, 63/40, 13, 1.11, 910, 1.16
See application file for complete search history.

(56) References Cited

U.S. PATENT DOCUMENTS 206,103 A * 7/1878 Gederen ..... 24/105
216,954 A * 7/1879 Heckmann ..... 24/705
3,853,416 A * 12/1974 Hanan ..... 403/322.1
4,501,050 A * 2/1985 Fountoulakis ..... 24/705
4,630,452 A * 12/1986 Connelly et al. ..... 63/12
4,793,155 A * 12/1988 Law ..... 63/40
4,996,851 A * 3/1991 Schinzinger et al. ..... 63/26
5,154,068 A * 10/1992 DiDomenico ..... 63/12
5,203,183 A * 4/1993 Salerno ..... 63/12
5,309,737 A * 5/1994 Fountoulakis ..... 63/12
5,375,433 A * 12/1994 Skalet ..... 63/12
5,411,516 A * 5/1995 Thomas ..... 606/188
5,491,985 A * 2/1996 Quattlebaum ..... 63/12
5,632,163 A * 5/1997 Inoue ..... 63/12
5,638,701 A * 6/1997 Dempsey ..... 63/12
5,743,113 A * 4/1998 Kogen ..... 63/12
5,893,277 A * 4/1999 Biagi ..... 63/12
5,893,278 A * 4/1999 Float et al. ..... 63/12
6,079,224 A * 6/2000 Schehr ..... 63/12
6,105,392 A * 8/2000 Biagi ..... 63/12
6,138,333 A * 10/2000 Hollingworth ..... 24/705
6,305,192 B1 * 10/2001 Indiveri et al. ..... 63/12
6,662,596 B1 * 12/2003 Tsutsumi ..... 63/1.15
6,675,613 B1 * 1/2004 Ashton ..... 63/12
6,865,907 B1 * 3/2005 Andrews et al. ..... 63/12

* cited by examiner

*Primary Examiner*—Robert J. Sandy
*Assistant Examiner*—David Reese
(74) *Attorney, Agent, or Firm*—David B. Waller & Associates; David B. Waller

(57) ABSTRACT

The present invention is an earring for a pierced ear comprising a shaft mounted on a base; a connector having a cavity for engaging the shaft and an adapter on the obverse; and a cap able to be affixed to the adapter on one side and a decorative aspect of the earring attached on the obverse.

11 Claims, 2 Drawing Sheets

SMOOTH BACKED PIERCED EARRING

TECHNICAL FIELD

Figure 1A:
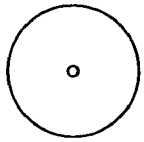
Figure 1B:
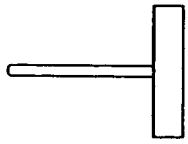
Figure 1C:
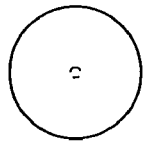
Figure 1D:
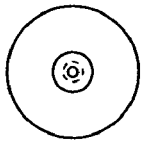
Figure 1E:
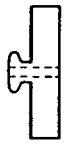
Figure 1F:
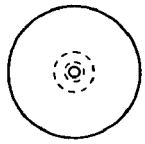
Figure 1G:
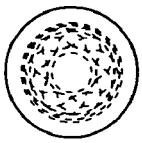
Figure 1H:
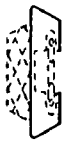
Figure 1I:
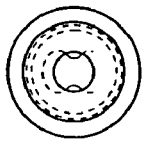

The present invention is directed to jewelry for pierced body parts. In particular, jewelry, such as an earring for a pierced ear having a smooth back and a plurality of interchangeable decorative aspects for affixing to the front.

BACKGROUND OF THE INVENTION

A large number of people worldwide have some part of their bodies pierced. A significant number of these individuals have pierced ears. Currently, pierced earrings are constructed with a pin, post or shaft affixed to the decorative aspect of the earring. During use the shaft is inserted into the pierced hole in the ear and the earring is secured in place with a backing. This backing generally has an aperture to receive the shaft that snaps into place on a groove provided along the circumference of the shaft near its end. These shafts are provided in a length that permits a majority of individuals having different ear thicknesses to wear the earring. Unfortunately, this often results in a portion of the shaft extending beyond the backing. When an individual wearing such earrings is required to use a communications device such as a cellular phone, head phones, telephone or other listening device the shaft is often driven into the back of the head causing irritation and discomfort. Often times the earring on the listening ear is removed to avoid this discomfort. When this is done the earring is sometimes forgotten, lost or stolen.

In addition, many consumers have a large number of pierced-ear earrings for different occasions. In each set of earrings the posts are usually made from a hypoallergenic material such as gold, platinum or surgical steel to minimize contact dermatitis reactions. Because of this a significant portion of the cost of these earrings often times comprises the post yet it is not part of the visible or decorative aspect of the jewelry. Previous attempts to reduce this associated cost have been limited in that they worked only for pendant-type earrings (U.S. Pat. No. 5,048,310). This severely limited the styles and types of earrings that could be used.

Consequently, there is a need in the industry for a device that reduces the discomfort experienced by having an exposed shaft on the back side of the jewelry as well as to reduce the overall cost resulting from the traditional design of a single post for each piece of jewelry.

SUMMARY OF THE INVENTION

The present invention provides a novel earring for a pierced ear comprising a shaft, said shaft having a base; a connector having a cavity with means for engaging said shaft and an adapter on the obverse; and a cap having a means for affixing to said adapter on one side and a decorative aspect of the earring attached on the obverse.

A variety of methods are provided for affixing the connector to the shaft. In one configuration the shaft is threaded and the means for engaging the shaft within the cavity of the connector is threaded and is able to receive the threaded shaft. In another configuration, the shaft is grooved and the means for engaging the shaft within the cavity of the connector are depressions that interlock with the grooved shaft. In yet another configuration, both the base and the connector have opposite magnetic charges and in still another configuration the connector cavity comprises a releasable adhesive to removably adhere to the shaft.

In one embodiment the means for affixing to the cap to the adapter is a clasping device. In one configuration the adapter is a nipple and the means for affixing the cap to the adapter is a cavity in the cap comprising a flexible component capable of expanding to receive the nipple and collapsing to grasp the nipple when the nipple is pressed into the cavity. In another configuration the adapter comprises a pin having a flat head extending perpendicularly from the obverse side of the connector; and the cap having a keyhole-shaped slot capable of receiving the pin head.

In yet another embodiment the shaft comprises, or is made of, a hypoallergenic material.

In another aspect of the invention a method of wearing the earring described above is provided comprising the steps of inserting the shaft through a pierced ear so that the base is flush against the back of the ear and the shaft protrudes from the front of the ear; affixing the connector onto the shaft by inserting the shaft into the cavity wherein the adapter is positioned away from the front of the ear; and affixing the cap to the adapter such that the decorative aspect is positioned away from the front of the ear.

In yet another aspect of the invention a kit is provided comprising a plurality of shafts of different lengths; at least two connectors for engaging the plurality of shafts, each having an adapter; and a plurality of caps for affixing to the connectors having a decorative aspect on the obverse.

BRIEF DESCRIPTIONS OF THE DRAWINGS

Figure 4:
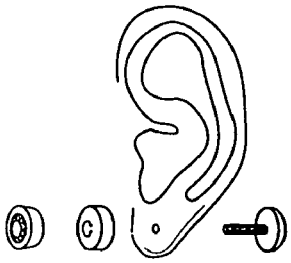
Figure 2A:
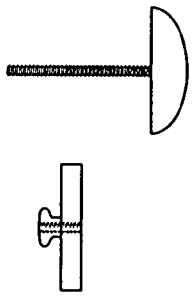
Figure 2B:
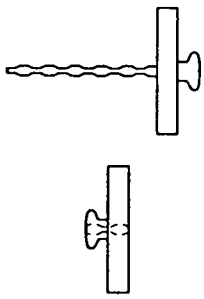
Figure 2C:
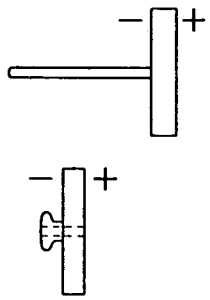
Figure 2D:
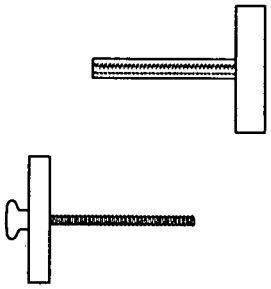
Figure 3A:
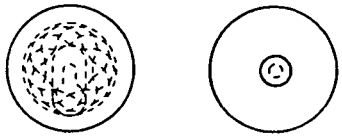
Figure 3B:
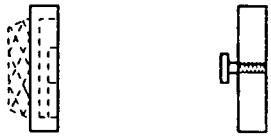
Figure 3C:
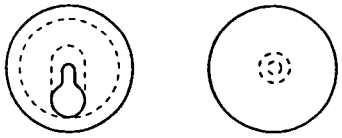

FIG. 1: Is a diagrammatic representation of the shaft and base (A) a front view; (B) a side view and (C) a back view, the connector with adapter (D) a front view; (E) a side view; and (F) a back view; and the cap and decorative aspect (G) a front view; (H) a side view and (I) a back view;

FIG. 2: Is a diagrammatic representation of the interface between the shaft and the connector (A) a threaded shaft and cavity; (B) a toothed shaft and cavity able to receive the toothed shaft; (C) a magnetic base and connector; and (D) a tubular shaft having threaded interior and connector with threaded post able to be received by the tubular shaft;

FIG. 3: Is a diagrammatic representation of the keyhole and pin connection for a connector and cap (A) a front view; (B) a side view and (C) a back view; and FIG. 4: an exploded perspective view showing the earring being affixed to an earlobe.

DETAILED DESCRIPTION

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "engaging means" as used herein refers to a method for securely interlocking one element of the invention to another element.

The term "adapter" as used herein refers to a portion of the connector used to effect operative compatibility between the connector and the cap.

The term "affixing means" as used herein refers to temporarily fastening one element of the invention to another element by a variety of methods known to one skilled in the art.

The term "decorative aspect" as used herein refers to the ornamental portion of the invention intended for display by the jewelry wearer.

The present invention provides a novel earring for a pierced ear comprising a shaft having a base, a connector having a cavity with means for engaging the shaft and an adapter on the obverse, and a cap having a means for affixing to the adapter on one side and a decorative aspect of the earring on the obverse. The invention further provides a method of wearing the earring comprising the step of inserting the shaft through a pierced ear so that the base is flush against the back of the ear and the shaft protrudes from the front of the ear, affixing the connector onto the shaft by inserting the shaft into the cavity wherein the adapter is positioned away from the front of the ear, and affixing the cap to the adapter such that the decorative aspect is positioned away from the front of the ear.

The Shaft

The shaft functions to couple the base of the earring to the remainder of the earring following insertion of the shaft into the pierced opening in the ear and anchoring the jewelry to the body.

The length of the shaft will vary depending on the length of the pierced opening through the body part intended to receive the shaft. Accordingly, the shaft may be provided in a variety of lengths. Preferably the length is sufficient to pass through the distance of the pierced body part with an amount extending beyond the exit of the pierced opening to receive the connector. Preferably the body part is an ear and most preferably an earlobe. If the earlobe is pierced the length of the shaft is that distance required to traverse the width of the earlobe plus an amount necessary to allow the connector to be securely and comfortably affixed. Preferably the length of the shaft is sufficient to allow the use of the earring to a large number of users. While one skilled in the art could provide the shaft in a length custom fit to each user, it is preferable to provide a limited number lengths that may be used universally for a majority of the population as well as to provide ease of manufacture, fabrication and to control costs. Correspondingly, the length of the shaft is not less than about ¼ inch for a smaller individual such as a child and not more than about 1 inch for a larger individual. Preferably, the length is not more than about ⅜ inch and not more than about ¾ inch. Most preferably the length is about ½ inch. Alternatively, the length of the shaft may be similar to those currently sold commercially for particular pierced body parts.

The width of the shaft will depend on the material used to construct the shaft to maintain structural integrity during use and the size of the pierced opening in the body part to receive the shaft. The width of the shaft is preferably slightly less than the width of the pierced opening in the body part. Since the width of the pierced opening may vary with each individual and body part, one skilled in the art would recognize that, for the most comfortable fit, the width should be just less than the size of the pierced opening. While the width of the shaft may be selected based on the size of each pierced opening it is preferable to have a universal width that may be utilized with comfort for a larger number of pierced openings. Correspondingly, one skilled in the art would recognize that the tensile strength of the material used to construct the shaft would determine the width that may be functionally utilized. For example, if the shaft were made of stainless steel, which has a high tensile strength, the shaft could be made with a smaller width. Correspondingly, if the shaft were made of gold, the width would have to be larger to provide the same or similar overall strength. Therefore, the width of the shaft should be not less than about 1/128 inch and not more than about ⅛ inch. Preferably not less than about 1/64 inch and not more than about 1/32 inch. Alternatively, the width of the shaft may be similar to those currently sold commercially for particular pierced body parts.

The surface of the shaft may be provided in a number of configurations and the selection of the configuration will depend on the configuration of the connector cavity. Preferably the surface of the shaft will interact with the cavity of the connector in such a way as to securely fasten the shaft to the connector, and accordingly, securely hold the jewelry to the body. For example, the cavity may comprise a piece of rubber having an aperture in line and slightly smaller in diameter than the width of the shaft it is to receive. When the shaft is inserted into the connector cavity the rubber aperture provides sufficient friction on the surface of the shaft to securely affix the jewelry in place. Correspondingly, the cavity may comprise a reversible clip that may engage a groove provided circumferentially on the shaft close to the end farthest from the base. When the shaft is inserted into the cavity, pressure is exerted on the clip. Once the groove reaches the clip, it snaps into place locking the connector to the shaft and thereby securing the jewelry to the body. A wide variety of other methods known to those skilled in the art may be used to secure the connector to the shaft. Additional methods include for example, threading the shaft and providing a threaded cavity in the connector, providing ribs along the shaft and corresponding flexible ribs within the cavity of the connector, and providing a releasable adhesive within the cavity of the connector which adheres to the shaft when it is inserted into the cavity. Alternatively, the shaft may be an internally threaded tube able to receive a threaded rod extending from the cavity of the connector or a threaded rod extending from the connector, which replaces the cavity. In another configuration, the base and the connector may be magnetized having opposite charges such that when the shaft is inserted into the cavity of the connector, the connector and the base attract each other, and thereby securing the jewelry in place. Preferably the surface of the shaft is threaded and may be received by a threaded cavity within the connector.

The shaft may be made of a variety of materials such as for example plastic, polymer or metal. More specifically, the shaft may be made of, for example, Teflon™, gold, platinum, metal alloy, or stainless steel. Preferably the material selected is hypoallergenic such as gold or platinum. Alternatively, the shaft may be a material plated with a hypoallergenic material, such as for example, a metal alloy plated with gold or platinum.

The shaft may be prepared from a variety of stock materials, such as for example, rod stock material having a circular, oval, square, rectangular or triangular profile. Cylindrical stock with a circular profile is preferred to provide a smooth surface when in contact with the skin. Alternatively, the shaft may be constructed of internally threaded round tubular stock that is able to accept a threaded rod from the connector.

The base is affixed to one end of the shaft and provides a backing such that when the shaft is inserted through the pierced opening and the connector is affixed to the shaft, the base and the connector act to clamp the pierced body part and hold the jewelry in place. The base generally has a front side from which the shaft extends, a back side and a perimeter. The base may be provided in a variety of shapes and has a generally smooth surface on both its front and back sides so that when pressed against the side of the head, no discomfort is experienced such as with the current style of pierced earrings. In addition, the base is provided in a size sufficiently long enough to prevent it from pulling through the pierced opening.

A number of shapes may provide a comfortable, generally smooth surface on the back side of the base, such as for example, a generally flat surface or a generally spherical surface. In the generally flat surface configuration, the length and width of the back is generally greater than its thickness. In this configuration the back side may be provided in a variety of shapes, such as for example, circular, square, rectangular, triangular, oval, elliptical, free-form or any of these shapes in combination. Correspondingly, the back side of the base may be dome shaped or irregular shaped but in either case, should be generally smooth so as to provide comfort during use. One skilled in the art would recognize that the actual shape that may be provided is only limited by the imagination of the individual preparing the base.

In a generally spherical configuration the length, width and height of the back side of the base may be similar or equivalent, for example, the shape may be spherical, a compressed spherical shape wherein the profile along the longest axis is an oval shape, or an irregular spheroid shape. In each of these cases, the back side is generally smooth so as to provide comfort during use. As stated above, one skilled in the art would recognize that the actual shape that may be provided is only limited by one's imagination.

The thickness of the base will vary depending on the material used to construct the base, the desired weight of the base and its desire visual profile. One skilled in the art would recognize that the base must be sufficiently thick to prevent deformation during use, that it must not be so heavy as to cause discomfort when being worn and that it have a pleasing appearance for the user. When the base is generally flat in configuration it may be preferable that the base be generally hidden from view. In such a case the thickness of the base would be relatively minimal to generally conceal its presence. Correspondingly, if the base was made of a high tensile strength material, such as stainless steel, the thickness could be thinner than if the base were made of a softer metal, such as gold, which would require a greater thickness to provide the same, or similar, strength as the thinner stainless steel. Consequently, if the base were made of stainless steel it may have a thickness not less than about 1/128 inch to not more than about 1/64 inch while if the base were made of gold the thickness might be not less than about 1/32 inch to not more than about 1/16.

Alternatively, it may be preferable to visually see the base in use or to utilize the base to affix a decorative element that does not interfere with the generally smooth surface and comfort provided by the present invention. In this configuration the thickness of the base may be greater to allow it to be seen and/or to affix other decorative aspects. In this instance, the thickness may be not less than about 1/16 inch and not more than about 1/8 inch.

When the base is generally spherical in configuration it may be preferable that the base be generally hidden from view. In such a case, the general diameter of the base would be relatively minimal to generally conceal its presence but sufficient to prevent the base from being drawn through the pierced opening. Consequently, the base may have a general diameter of not less than about 1/16 inch to not more than about 1/8 inch.

Alternatively, it may be preferable to visually see the base in use or utilize the base to affix a decorative element that does not interfere with the generally smooth surface that prevents discomfort during use. In this configuration, the thickness of the base may be greater to allow it to be seen and/or to affix other decorative aspects. For example, the thickness may be not less than about 3/16 inch and not more than about 1/2 inch.

The front side of the base that contacts the skin is preferably smooth and made of, or surfaced with, a hypoallergenic material such as for example Teflon™, gold or platinum.

The base is preferably lightweight to avoid discomfort during use. Consequently, the base may be made from solid stock material or it may be made in hollow form to reduce weight. For example, when the base is generally flat it may be made of a solid stock material having a suitable thickness. Correspondingly, if the base is generally spherical it may be preferable to prepare the base in a hollow configuration to avoid unnecessary weight. One skilled in the art would recognize that some jewelry might be heavier than desired simply because of the inherent weight of its decorative aspects. Such as for example, with earrings, the gemstone or gemstones utilized in the decorative aspect may add significant weight. In such a case, the earring may hang unevenly on the earlobe, tending to droop downward. To avoid this potential concern the base may be provided with an arm that extends up the back of the ear to stabilize the heavier earrings and reduce their tendency to turn downward. In any case it is preferable that the base be not less than about 1 gram and not more than about 10 grams most preferably about 5 grams.

The base may be constructed of a variety of materials such as for example silver, gold, platinum, stainless steel or polymer. Preferably the base is made of the same material used to construct the shaft.

In another configuration the base may have a decorative aspect that may be seen extending from the back of the jewelry. This aspect may be static, in a fixed position, or dynamic, able to move during use. If the aspect is static it may be provided as part of the base or may be connected to the base permanently or removably. If for example, the jewelry was an earring and if the decorative aspect was a bezel set gemstone, the bezel set gemstone may be provided on a wire affixed to the perimeter edge of the base looping around the base of the earlobe so that the gemstone faces forward adding to, or enhancing, the decorative aspect provided by the cap. If the aspect is dynamic it may be connected to the base permanently or removably. If for example, the jewelry was an earring and if the decorative aspect were dangles, the perimeter of the base may comprise a loop on which the dangles could be affixed so that they could move freely and be seen from the front adding to, or enhancing, the decorative aspect provided by the cap. One skilled in the art would recognize that such decorative aspects might be provided in a variety of methods limited only by one's imagination. For example, a dynamic decorative aspect may be affixed to the base by the use of a bearing so that the decorative aspect could rotate. Alternatively, the base may have a clip, snap or loop that allows a decorative aspect to be affixed to the back side of the base. In each of these cases, the decorative aspect either does not interface with the side of the head when in place or is smooth to avoid irritation in use.

In another configuration, the base and the connector are magnetized and of opposite charges such that when the shaft is inserted through the pierced opening and into the cavity of the connector, the opposite magnetic charges attract securing the jewelry to the body. The magnetic force of attraction between the two elements may be varied depending on the strength of the magnets, the amount of force required to secure the jewelry to the body part, and the comfort desired during use. A large number of different types of magnets with differing strengths are available commercially. To determine the strength that would be preferred by a user, one skilled in the art may simply apply magnets of a particular strength to the body part to be affected and assess from the user if the force exerted between the magnets is sufficient to maintain the jewelry in place and whether or not the pressure exerted by the magnets is comfortable. If not, alternative less powerful magnets may be applied until the desired characteristics and comfort are obtained. Alternatively, there are, for example, magnetic connectors for earrings available commercially and the same type, or similar types of magnets used in these earrings may be applied to the present invention.

The Connector

The connector functions to bracket the pierced body part against the base and lock the jewelry in place. The connector comprises a housing having a top surface on which there is an adapter and a bottom surface which interfaces with the pierced body part, a perimeter and a cavity extending through the housing preferably along a linear path generally perpendicular to the top and bottom surfaces.

The shape of the connector may vary depending on whether it is intended to add to, or enhance, the decorative aspect of the cap. Alternatively, it may be desirable for the connector to be relatively hidden from view by the cap. The decorative aspect of the connector may be static or dynamic. If, for example, the pierced jewelry is an earring and the decorative aspect is static the decorative aspect could be a ring of gemstones provided along the perimeter of the connector such that when the cap is affixed, the gemstones encircle the cap. Alternatively, if the decorative aspect was dynamic it could be a plurality of dangles affixed to a loop or ring provided on the perimeter of the connector so that they move freely. In either of these configurations, a portion of the connector may be exposed and visible when the cap is in place. Therefore, the portion of the connector that is visible around the cap may have a shape that provides an additional decorative aspect to the jewelry. This shape may be relatively flat, such as for example, a star shape wherein the points of the star are visible around the cap when the cap is in place. Alternatively, the shape may have a three dimensional configuration, such as for example, the shape of a hand appearing to grasp the cap when it is positioned in place. In fact, one skilled in the art would recognize that a variety of shapes may be available and only limited by ones imagination.

If it is desirable to have the connector relatively hidden from view, the shape may be such that the cap covers it or when the cap is in place the connector appears to be part of the cap by incorporating a portion of the decorative aspect of the cap.

The thickness of the connector will depend on the material used to construct the connector, whether it is desirable to visually see the connector when in place and whether the connector will incorporate a decorative aspect. When considering the thickness of the connector, it is generally referring to the area excluding the adapter, as the adapter does not generally affect the thickness since it is incorporated into the cap when the cap is in place. Therefore, if it is desirable for the connector to be relatively hidden from view during use, it may be provided in a thin configuration so as to be less obvious. Correspondingly, if it is intended to enhance, or add to, the decorative aspect of the pierced jewelry, it may be provided in a thicker configuration that would allow affixing of a decorative aspect or in a thicker configuration incorporating a decorative element. In either case, the thickness of the connector will depend on the structural integrity necessary to prevent deformation during use and the cost associated with preparing the desired construction.

If the connector is made of a high tensile strength material, such as stainless steel, the thickness could be thinner than if the connector were made of a softer metal, such as gold, which would require a greater thickness to provide the same, or similar, strength as the stainless steel. Correspondingly, if a thicker connector is desired it may be constructed in a hollow form configuration to reduce weight and cost.

The connector may be made of a variety of materials such as for example a polymer, a metal or a combination of both. In particular, the connector maybe made of materials, such as for example, Teflon™, gold, platinum, metal alloy, or stainless steel. Preferably the material selected is hypoallergenic such as gold or platinum. Alternatively, the entire connector or primarily the bottom surface may be plated with a hypoallergenic material, such as for example, a metal alloy plated with gold or platinum.

The connector cavity may be provided in a variety of configurations to receive the shaft and secure the jewelry to the body. For example, the cavity may comprise a piece of rubber having an aperture in line and slightly smaller in diameter than the width of the shaft it is to receive. When the shaft is inserted into the connector cavity the rubber aperture provides sufficient friction on the surface of the shaft to securely affix the jewelry to the body. Correspondingly, the cavity may comprise a reversible clip that may engage a groove provided circumferentially on the shaft close to the end farthest from the base. When the shaft is inserted into the cavity, pressure is exerted on a spring clip which then exerts pressure on the shaft as it moves into the cavity. Once the groove reaches the clip, it snaps into place locking the connector to the shaft and securing the jewelry in place. A wide variety of methods known to those skilled in the art may be used to secure the connector to the shaft. Additional methods include, for example, providing a threaded cavity for a threaded shaft, providing flexible ribs within the cavity to receive a ribbed shaft, or providing a releasable adhesive within the cavity of the connector, which adheres to the shaft when it is inserted into the cavity. In another configuration, the base and the connector may be magnetic, each having an opposite charge such that when the jewelry is assembled, the connector and the base attract, securing the jewelry to the body. In this configuration, the cavity is merely acting as a guide to maintain the shaft generally perpendicular to the connector and base. Preferably the cavity is threaded and able to receive a threaded shaft.

The length of the connector cavity is generally equivalent to the thickness of the connector including the distance the adapter projects from its top surface. This length will generally depend on the design of the pierced jewelry. Alternatively, if the shaft is to be part of the decorative aspect it may be necessary to have the shaft extend sufficiently past the adapter to allow interaction with the cap.

The diameter of the connector cavity will vary depending on the diameter of shaft. In general, the cavity diameter is slightly smaller than the diameter of the shaft it is to receive. In the case where the connector and the base are magnetic and the cavity is merely acting as a guide, the cavity diameter is generally slightly larger than the diameter of the shaft. For example, if the pierced jewelry is an earring and a standard commercially available shaft is utilized with the present invention, the diameter of the cavity in the connector may be identical, or similar to, the diameter provided in the standard commercially available pierced earring backing.

In another configuration a threaded rod may be affixed within the cavity that may be received by an internally threaded tubular shaft. The rod is preferably permanently affixed within the cavity or may be provided on a connector as a replacement to the cavity. The rod may be affixed in the cavity by a variety of methods known to those skilled in the art including for example, by threading into the cavity, by adhesive, solder or welding.

The adapter is provided on the top surface of the connector and functions to interlock the connector with the cap. A variety of adapter configurations known to those skilled in the art may be utilized with the present invention to perform this function. For example, if the connection between the connector and the cap is a snap then the adapter may be provided in the shape of a nipple to be received within a cavity in the cap having a spring clip to grasp and secure the nipple during use. Alternatively, the connection may be a pin and keyhole configuration wherein the adapter is a pin with a head that may be received by the larger round opening of the key hole and the pin diameter being able to slip into the smaller elongated opening of the keyhole, locking the cap in place. Correspondingly, the connection may be magnetic such that the connector and the cap have opposite charges. In this configuration the adapter may be a rod and the cap cavity merely a guide to receive the rod and assure that the connector and the cap are in alignment during use.

The adapter may be positioned in a variety of locations on the connector but is preferably generally in the center of the top surface. In this position, the cavity of the connector will extend through the adapter traversing the connector. Alternatively, the adapter may be positioned off center on the top surface of the connector. In this configuration the connector cavity may not pass through the adapter and the portion of the connector visible around the cap when in place may be utilized to enhance, or add to, the decorative aspect of the cap.

The adapter may be provided as a single piece with the connector or it may be constructed separately and affixed to the connector. The adapter may be made of a variety of materials that maintain their structural integrity over continued use such as for example metal alloy, stainless steel, low carat weight gold, such as 10 or 14 carat gold, or platinum. Preferably the adapter is made of the same material as the connector.

In another configuration the connector top surface is magnetized and the back side of the cap is magnetized each having opposite charges so that the backside of the cap is magnetically held onto the top side of the connector. In this configuration an adapter may be present as discussed above or may be absent.

The Cap

The cap provides a decorative aspect on its front side, a cavity to receive the adapter on the back side and a perimeter along its edge. The cavity on the back side of the cap is able to engage the adapter during use, securing the cap to the body. The general function of the cap is to provide a decorative aspect to the pierced jewelry.

The front side of the cap may be provided in a wide variety of shapes, designs, or configurations that may be pleasing to the user. One skilled in the art would recognize that the actual number and variations of possible shapes, designs or configurations are only limited by one's imagination. For example, the cap may be a geometric shape such as a sphere, it may be the shape of an animal, it may comprise a prong or bezel setting for a gemstone or it may have the three dimensional shape of a flower. The cap may have movable elements, such as for example, dangles, or it may have rotating elements connected to the cap through a miniature bearing that is activated by movement of the user. Alternatively, the motion may be energy driven such as by incorporation of a miniature battery and/or motor in the cap to activate the moving elements. Such a powered system provided within the cap could be utilized to activate small light emitting diodes. A twist switch currently used in similar devices available commercially may be utilized to turn the supply of energy on and off.

The cavity on the back side of the cap functions to engage the adapter and secure the cap to the connector. The cap cavity may be provided in a variety of configurations to receive the adapter and allow the decorative aspect to be secured to the jewelry. For example, the cavity may comprise a piece of rubber having an aperture slightly smaller in diameter than the width of the adapter nipple. When the nipple is inserted into the cap cavity the rubber aperture flexes allowing entry of the nipple then closes around the nipple providing sufficient friction on the nipple to securely affix the cap to the connector. Correspondingly, the cavity may comprise a spring clip that engages the nipple when the cap is pressed onto the connector. When the nipple is inserted into the cavity, pressure is exerted on a circular spring clip, which increases in diameter to receive the head of the nipple. Once the head moves past the spring clip, the clip springs back to its resting diameter closing about the waist of the nipple securing the cap in place. In another configuration, the cap and the connector may be magnetic, each having an opposite charge such that when the jewelry is assembled, the connector and the cap attract, securing the cap to the connector. In this configuration the adapter may be a rod and the cavity may merely act as a guide to maintain the rod generally perpendicular to the cap. In yet another configuration, the cavity may comprise a flexible material capable of expanding to receive a nipple-shaped adapter and retracting to receive the nipple when the nipple and cap and pressed together. Alternatively, the connection may be a pin and keyhole configuration wherein the adapter is a pin with a head that may be received by the larger round opening of the key hole and the pin diameter able to slip into the smaller elongated opening of the keyhole, locking the cap in place.

In another configuration the backside of the cap is magnetized and the top of the connector is magnetized each having opposite charges so that the backside of the cap is magnetically held onto the top side of the connector. In this configuration a cavity may be present as discussed above or may be absent.

Preferably the connection between the connector and the cap is a snap-fit configuration in which the adapter is a nipple and the cavity comprises a circular spring clip to grasp the nipple when inserted into the cavity. A wide variety of similar miniature snaps are available commercially in fabric stores and are often used for women's clothing.

Assembly

The jewelry may be provided in assembled or disassembled form. In either case, the earring may be assembled by either the consumer or by the manufacturer prior to use or sale. When the pierced jewelry is an earring, assembly is achieved by inserting the shaft through a pierced earlobe until the base fits flush against the back of the earlobe and the shaft protrudes from the front of the earlobe. The connector is then affixed onto the protruding shaft by inserting the shaft into the cavity in the connector, so that the adapter is positioned away form the earlobe. The cap is then affixed to the adapter so that the decorative aspect is positioned away from the front of the earlobe.

Kit

A variety of kits may be provided to the consumer, which may contain one or more shafts of varying lengths, at least two connectors, and a plurality of caps. Preferably, the kit contains a plurality of caps corresponding to each connector.

I claim:

1. An earring for a pierced ear comprising:

(a) a shaft, said shaft being mounted on a base;

(b) a connector having a top surface and a bottom surface, a cavity with means for engaging said shaft for fitting flush against a pierced ear on said bottom surface and an adapter projecting from said top surface of the connector, said adapter being a nipple; and (c) a cap having a cavity to receive said adapter on one side and a decorative aspect of the earring attached on the other side, said cap comprising a flexible component capable of expanding to receive said nipple and retracting to grasp said nipple when said nipple and said cavity are pressed together.

2. The earring according to claim 1 wherein said shaft comprises or is made of a hypoallergenic material.

3. The earring according to claim 1 wherein said shaft is threaded and wherein said means for engaging said shaft is threaded in said cavity able to receive said threaded shaft.

4. The earring according to claim 1 wherein said shaft is grooved and wherein said means for engaging said shaft are depressions in said cavity that interlock with said grooved shaft.

5. The earring according to claim 1 wherein said cavity to receive said adapter further comprises a clasping device.

6. A method of wearing an earring for a pierced ear comprising a shaft, said shaft having a base; a connector having a top surface and a bottom surface, a cavity with means for engaging said shaft for fitting flush against a pierced ear on said bottom surface and an adapter projecting from said top surface of the connector, said adapter being a nipple; and a cap having a cavity to receive said adapter on one side and a decorative aspect of the earring attached on the other side, said cap comprising a flexible component capable of expanding to receive said nipple and retracting to grasp said nipple when said nipple and said cavity are pressed together comprising the step of:

(a) inserting said shaft through a pierced ear wherein said base is capable of fitting flush against a back of a pierced ear and said shaft protrudes from a front of a pierced ear;

(b) affixing said connector onto said shaft by inserting said shaft into said cavity wherein said adapter is positioned away from a front of a pierced ear; and (c) affixing said cap to said adapter such that said decorative aspect is positioned away from a front of a pierced ear.

7. An earring for a pierced ear comprising:

(a) a shaft, said shaft being mounted on a base;

(b) a connector having a top surface and a bottom surface, a cavity with means for engaging said shaft for fitting flush against a pierced ear on said bottom surface and an adapter projecting from said top surface of the connector, said adapter being a pin having a flat head extending perpendicularly from the top surface of said connector; and (c) a cap having a key-hole-shaped slot capable of receiving said pin head of said adapter on one side and a decorative aspect of the earring attached on the other side.

8. The earring according to claim 7 wherein said shaft comprises or is made of a hypoallergenic material.

9. The earring according to claim 7 wherein said shaft is threaded and wherein said means for engaging said shaft is threaded in said cavity able to receive said threaded shaft.

10. The earring according to claim 7 wherein said shaft is grooved and wherein said means for engaging said shaft are depressions in said cavity that interlock with said grooved shaft.

11. A method of wearing an earring for a pierced ear comprising a shaft, said shaft being mounted on a base; a connector having a top surface and a bottom surface, a cavity with means for engaging said shaft for fitting flush against a pierced ear on said bottom surface and an adapter projecting from said top surface of the connector, said adapter being a pin having a flat head extending perpendicularly from the top surface of said connector; and a cap having a keyhole-shaped slot capable of receiving said pin head of said adapter on one side and a decorative aspect of the earring attached on the other side comprising the step of:

(a) inserting said shaft through a pierced ear wherein said base is capable of fitting flush against a back of a pierced ear and said shaft protrudes from a front of a pierced ear;

(b) affixing said connector onto said shaft by inserting said shaft into said cavity wherein said adapter is positioned away from a front of a pierced ear; and (c) affixing said cap to said adapter such that said decorative aspect is positioned away from a front of a pierced ear.

* * * * *